United States Patent [19]

Lonsberry

[11] Patent Number: 4,927,343

[45] Date of Patent: May 22, 1990

[54] LUBRICATION OF GEAR PUMP TRUNNIONS

[75] Inventor: Kenneth F. Lonsberry, Hudson, Ohio

[73] Assignee: Permco, Inc., Streetsboro, Ohio

[21] Appl. No.: 389,625

[22] Filed: Aug. 3, 1989

Related U.S. Application Data

[63] Continuation-in-part of Ser. No. 254,209, Oct. 6, 1988, abandoned.

[51] Int. Cl.[5] ..... F03C 2/08; F04C 2/18; F04C 15/00

[52] U.S. Cl. ..... 418/102; 418/132

[58] Field of Search ..... 418/102, 132

[56] References Cited

U.S. PATENT DOCUMENTS

| | | | |
|---|---|---|---|
| 3,076,413 | 2/1963 | Hoffer | 418/102 |
| 3,690,793 | 9/1972 | Pollman et al. | 418/102 |
| 4,392,798 | 7/1983 | Bowden | 418/102 |
| 4,470,776 | 9/1984 | Kostek et al. | 418/132 |

FOREIGN PATENT DOCUMENTS

| | | | |
|---|---|---|---|
| 2502793 | 7/1976 | Fed. Rep. of Germany | 418/102 |

*Primary Examiner*—John J. Vrablik

*Attorney, Agent, or Firm*—James A. Hudak

[57] ABSTRACT

A thrust plate for a gear pump or motor which permits the use of high pressure fluid from the outlet side thereof to lubricate the trunnions and bushings therein. The thrust plates include two small bores which pass therethrough the which are in fluidic communication with the inlet side of the pump via the surface of the thrust plate that confronts the gears within the pump. The foregoing bores are also in fluidic communication with the bushings by means of associated slots in the opposite side of the thrust plate. The opposite ends of the bushings are in fluidic communication with fluid at atmospheric pressure. By minimizing the size of the foregoing bores and by allowing the passage of fluid through same to the inlet side of the pump via the gear tooth confronting surface of the thrust plate, pressure gradients are created across the trunnions and their associated bushings. These pressure gradients permit high pressure fluid to traverse outwardly from the thrust plate along the surface of the trunnions to the approximate end thereof to lubricate same and then to move inwardly along the trunnions toward the thrust plate and to pass therethrough via the bores therein.

12 Claims, 3 Drawing Sheets

LUBRICATION OF GEAR PUMP TRUNNIONS

This is a continuation-in-part of copending application Ser. No. 07/254,209 filed on Oct. 6, 1988, abandoned.

TECHNICAL FIELD

The present invention relates, in general, to a system for lubricating a gear pump or motor and, more particularly, to a system that utilizes high pressure outlet fluid for lubricating the trunnions and associated bushings within the gear pump or motor.

BACKGROUND ART

Many techniques have been devised for lubricating trunnions and their associated bushings in gear pumps or motors. Some approaches use high pressure fluid from the outlet side of the pump or motor for such lubrication. Typically, such an approach results in the loss of volumetric and overall efficiency of the pump or motor. Other approaches utilize low pressure fluid from the inlet side of the pump or motor to lubricate the trunnions and bushings. These latter approaches are based upon the principle that the inlet fluid is typically at atmospheric pressure and that the fluid at the point of the unmeshing of the gears adjacent the inlet side is at a pressure that is less then atmospheric pressure. Because of this pressure gradient, the fluid at the inlet side can theoretically pass through the area between the trunnions and the bushings, thus lubricating same. However, in order to accomplish the foregoing, a groove must be provided in the face of the thrust plate to permit the passage of fluid from the bushings to the inlet side of the pump or motor. Because of the configuration and size of the groove, and the positioning of same, it has been found that the foregoing pressure gradient is significantly less than what is theoretically expected, resulting in a substantial loss in volumetric efficiency, inefficient trunnion lubrication and elevated bushing temperature. This is particularly true if the groove for the passage of the fluid from the bushing to the inlet side of the pump is on the surface of the thrust plate adjacent the sides of the gears, as in U.S. Pat. No. 4,470,776. The positioning of the foregoing groove on this particular surface of the thrust plate decreases the effectiveness of the required seal between the thrust plate and the face of the gears which, in turn, diminishes the pressure gradient across the bushing permitting fluid to traverse down the trunnion. Such "leakage" increases volumetric losses and reduces the resulting output flow from the pump or motor.

Because of the foregoing, it has become desirable to develop a lubrication system for a gear pump or motor that provides sufficient lubrication of the trunnions and bushings therein and does not affect the overall efficiency of the device.

SUMMARY OF THE INVENTION

The present invention solves the problems associated with the prior art and other problems by providing a lubrication system for a gear pump or motor which utilizes high pressure fluid from the outlet side thereof to lubricate the trunnions and bushings therein. To accomplish the foregoing, high pressure fluid from the outlet pressure side of the pump or motor is allowed to pass between the sides of the gears and the smooth inner face of the thrust plate which is adjacent thereto. The passage of the foregoing high pressure fluid causes a pressure gradient to be created between the thrust plate and the ends of the trunnions and their associated bushings, which are at atmospheric pressure. A pressure gradient is also created across the diametrically opposite side of the trunnions and their associated bushings by means of small bores which pass through the thrust plate and which are in communication with the inlet side of the pump via the smooth side of the thrust plate. The foregoing bores are in communication with the bushings by means of slots in the non-wear sides of the thrust plates. The latter pressure gradient is created by minimizing the size of the foregoing bores and by allowing the passage of fluid through same to the inlet side of the pump via the smooth side of the thrust plate. The foregoing pressure gradients permit the high pressure fluid to traverse outwardly from the thrust plate along the surface of the trunnions to the approximate end thereof to lubricate same and then to move inwardly along the trunnions toward the thrust plate and to pass therethrough via the bores therein for subsequent intermixing with the fluid in the inlet pressure chamber. This fluid can then be subsequently transmitted to the fluid outlet chamber through the intermeshing of the gears.

DETAILED DESCRIPTION OF THE PREFERRED EMBODIMENT

Figure 1:
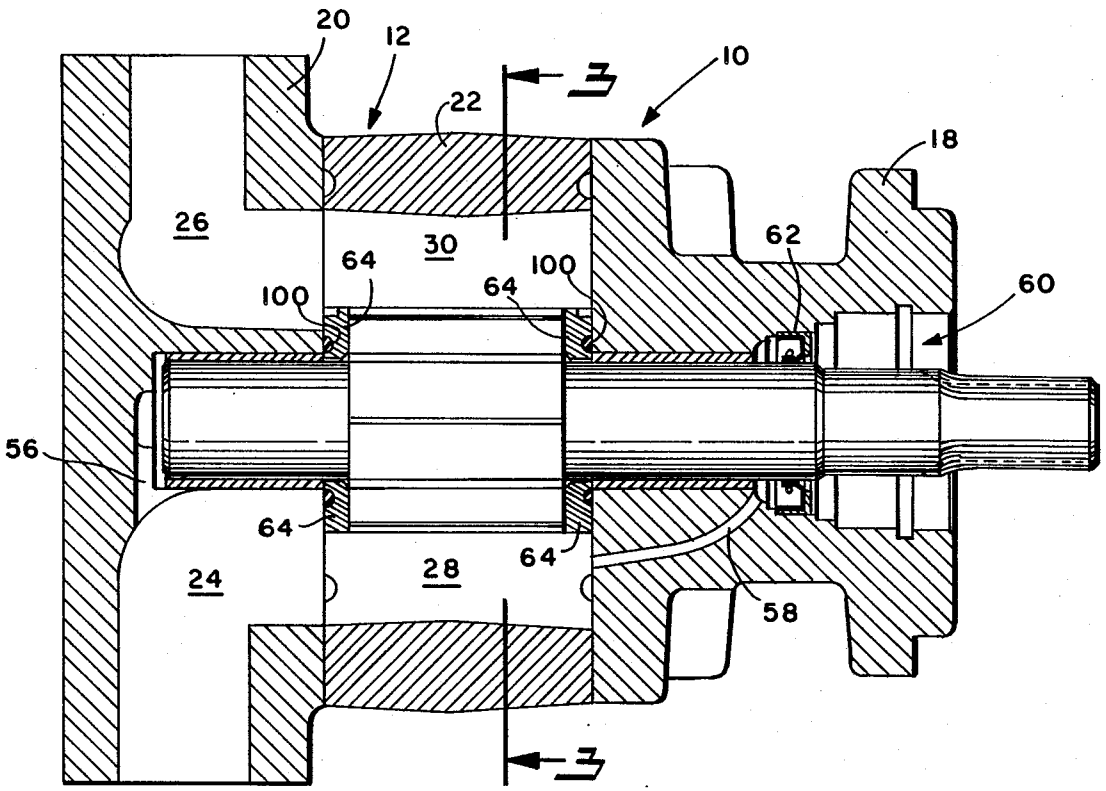
FIG. 1 is a front elevational view, in cross-section, of the present invention.
Figure 2:
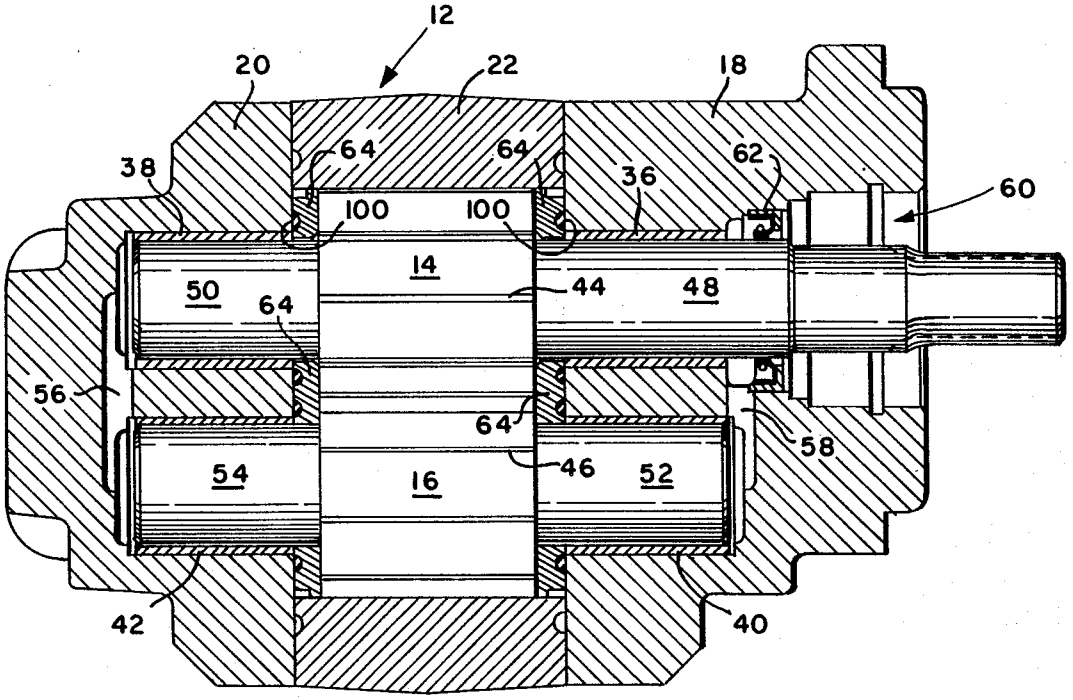
FIG. 2 is a top plan view, in cross-section, of the present invention.

Referring now to the drawings where the illustrations are for the purpose of describing the preferred embodiment of the present invention and are not intended to limit the invention hereto, FIGS. 1 and 2 illustrate the construction of a rotary gear pump 10 which may also be used as a fluid motor. The gear pump 10 includes a housing assembly, shown generally by the numeral 12, and includes intermeshed driving and driven gears 14 and 16, respectively, rotatably supported within the housing assembly 12. The housing assembly 12 includes a front housing portion 18, a rear housing portion 20 and an intermediate housing portion 22, all joined together by appropriate fastening means (not shown).

Figure 3:
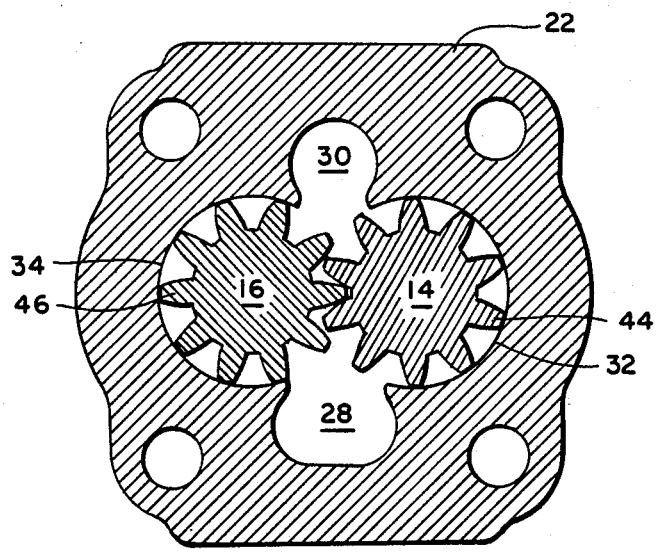
FIG. 3 is a cross-sectional view taken along section-indicating lines 3—3 of FIG. 1.

The rear housing portion 20 of the housing assembly 12 includes a low pressure fluid inlet port 24 and a high pressure fluid outlet port 26 which communicate with inlet and outlet pressure chambers 28 and 30, respectively, in the intermediate housing portion 22, as shown in FIG. 3. The axes of inlet and outlet pressure chambers 28 and 30 are substantially perpendicular to the axes of the fluid inlet port 24 and fluid outlet port 26, respectively, and substantially parallel to the axes of the gears 14 and 16. The intermediate housing portion 22 also includes arcuate surfaces 32 and 34, forming a generally figure-eight configuration, that respectively conform to the periphery of the gears 14 and 16, respectively.

Gear 14 is rotatably supported by bushings 36 and 38, whereas gear 16 is rotatably supported by bushings 40 and 42 within the front housing portion 18 and the rear housing portion 20, respectively, of the housing assembly 12. The gears 14 and 16 include teeth 44 and 46, respectively, located within the intermediate housing portion 22, the tips of the gear teeth being adjacent the arcuate surface 32 and 34, respectively, therein. Gear 14 also includes oppositely directed, outwardly extending trunnions 48 and 50, respectively received within bushings 36 and 38, whereas gear 16 includes similar oppositely directed, outwardly extending trunnions 52 and 54 received within bushings 40 and 42, respectively. One end of the trunnions 50 and 54 and the adjacent end of the respective bushings 38 and 42 which surround same are in fluidic communication with the fluid inlet port 24 by means of a passageway 56 within the rear housing portion 20. Passageway 56 is of such a configuration that fluid flowing through the fluid inlet port 24 can easily communicate with the ends of the trunnions 50 and 54 of the gears 14 and 16, respectively, and with the ends of their respective associated bushings 38 and 42. A fluid passageway 58 is provided in the front housing portion 18 adjacent inlet pressure chamber 28 in the intermediate housing portion 22 permitting the ends of the trunnions 48 and 52 and the ends of their respective associated bushings 36 and 40 to be in fluidic communication with the inlet pressure chamber 28. The shaft portion of the driving gear 14 extends through an opening, shown generally by the numeral 60, in the front housing portion 18 and is adapted to receive a suitable drive or actuator (not shown) which imparts rotation thereto. An oil seal 62 is received within the opening 60 in the front housing portion 18 adjacent passageway 58 and surrounds the shaft portion of the driving gear 14 preventing oil from escaping from the housing assembly 12.

Figure 4:
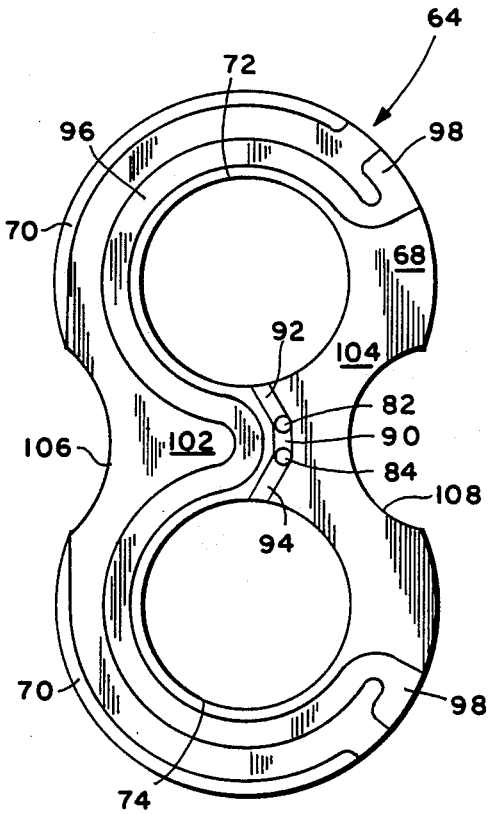
FIG. 4 is a front elevational view of the outer face of the thrust plate utilized in the present invention.
Figure 5:
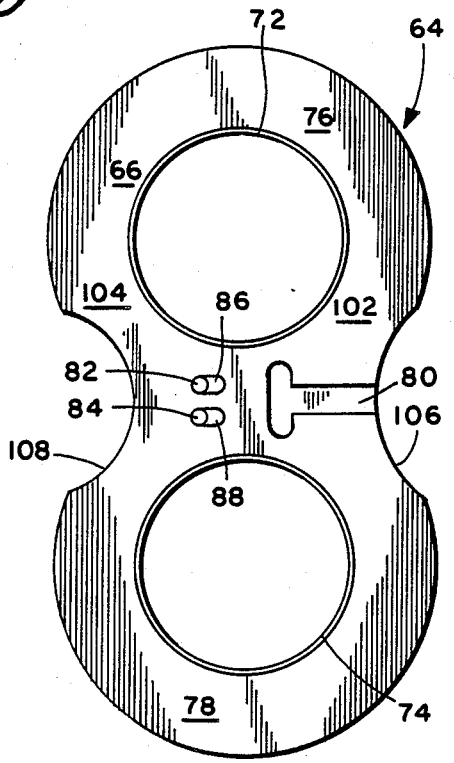
FIG. 5 is a front elevational view of the reverse side of the thrust plate shown in FIG. 4, and illustrates the inner face of the thrust plate of the present invention.

A thrust plate 64, as shown in FIGS. 4 and 5, having a generally figure-eight configuration is positioned within the intermediate housing portion 22 so as to be disposed on either side of the gears 14 and 16 and to be flush with same. Each thrust plate 64 has an inner face 66 and an outer face 68. The inner face 66 has a generally planar, smooth surface while the outer face 68 has a stepped surface for a portion of the outer periphery thereof forming a pair of oppositely disposed recesses 70 on the edge thereof. When the thrust plates 64 are assembled in the pump, a thrust plate is positioned against each end of the gears 14 and 16 such that its smooth inner face 66 is adjacent the side of the gears and its outer face 68 abuts either the ends of the bushings 38 and 42 and the rear housing portion 20 or the ends of the bushings 36 and 40 and the front housing portion 18. The thrust plates 64 are positioned so that the oppositely disposed recesses 70 are adjacent the outlet pressure chamber 30. Circular apertures 72 and 74 in the generally circular portions 76 and 78, respectively, of the thrust plates 64 slidably receive the trunnions 48 and 52 or 50 and 54 of the respective gears 14 and 16. A chamfer is provided on each aperture 72 and 74 adjacent smooth inner face 66 thereof so as to be adjacent the gears 14 and 16. In accordance with conventional practice, a T-shaped return channel 80 is formed in the smooth inner face 66 of the thrust plate 64. This channel 80 returns high pressure fluid trapped between the meshing gears back toward the high pressure outlet pressure chamber 30.

The recess 70 is provided around a portion of the periphery of the generally circular portion 76 and 78 of the thrust plate 64. The surface defining the recess 70 is substantially parallel to both the inner and outer faces 66 and 68 of the thrust plate 64. The recess 70 is used to stabilize pressure forces on the thrust plate 64 when the pump is in operation. Spaced-apart bores 82 and 84 having substantially the same diameter are provided through the thrust plate 64 and interconnect the inner and outer face 66 and 68 of same. The location of the bores 82 and 84 is such so as to be substantially adjacent the point where the gears 14 and 16 begin unmeshing and to be in close proximity to the inlet pressure chamber 28. The bores 82 and 84 are positioned so that bore 82 is aligned with teeth 44 on gear 14 whereas bore 84 is aligned with teeth 46 on gear 16. In addition, the bores 82 and 84 are aligned vertically resulting in bore 82 being covered by a tooth 44 on gear 14 while bore 84 is aligned with the interdental space between adjacent teeth 46 on gear 16, and vice versa. The diameter of each bore 82 and 84 is substantially less than the width of their respective adjacent gear teeth 44, 46 at their respective point of alignment. Bores 82 and 84 intersect elongated slots 86, 88, respectively, in the inner face 66 of the thrust plate 64. The elongated slots 86, 88 have a transverse width which is substantially equal to the diameter of bores 82 and 84 and are substantially parallel to each other. Elongated slots 86, 88 are positioned so that one end thereof corresponds with the surface defining bores 82, 84, respectively, and are inwardly directed toward T-shaped return channel 80. An elongated slot 90 is provided in the outer face 68 of the thrust plate 64 and interconnects the bores 82 and 84. A slot 92 interconnects aperture 72 with bore 82 and one end of slot 90 while a slot 94 interconnects aperture 74 with bore 84 and the other end of slot 90. The depths of the slots 90, 92 and 94 are substantially the same.

A continuous groove 96 in the form of an inverted numeral 3 is provided in the outer face 68 of the thrust plate 64 and substantially conforms to the configuration of the outer periphery of the thrust plate and is spaced apart from the edge thereof. Each end of the continuous groove 96 terminates in a recess 98 adjacent the outer periphery of the thrust plate 64. A seal 100 having a configuration complementary to that of the continuous groove 96 and the recesses 98 is received therein and provides a sealing surface between the thrust plate 64 and the adjacent front and rear housing portions 18 and 20. The seal 100 is substantially oval in cross-section and has a recess along the inner edge thereof. A back-up member (not shown), having configuration complementary to that of the seal 100, is received within the recess in the seal 100 and retains same within the groove 96 and the recesses 98 in the thrust plate 64. The seal 100 divides the outer face 68 of the thrust plate 64 into a high pressure portion and a low pressure portion, shown generally by the numerals 102 and 104, respectively. Because of the fluidic communication provided by the bores 82 and 84 through the thrust plate 64, the oppositely disposed portions of the inner face 66 of the thrust plate 64 are similarly divided into a high pressure portion 102 and a low pressure portion 104. Arcuate recesses 106 and 108 are provided in the edge of the thrust plate 64 adjacent the high pressure portion and low pressure portion 102 and 104, respectively, and interconnect the generally circular portions 76 and 78 of the plate 64. The radius used for each arcuate recess 106 and 108 is such so as to optimize performance of the pump.

Operationally, as the driving gear 14 is rotated, the spaces between the teeth 44 and 46 of the driving gear 14 and driven gear 16, respectively, pass the inlet pressure chamber 28 allowing fluid to be impounded therebetween and carried around the intermediate housing portion 22 to the outlet pressure chamber 30. In this manner, fluid under low pressure drawn through the low pressure fluid inlet port 24 is pressurized and discharged through the high pressure fluid outlet port 26.

When the pump 10 is operating, the pressure of the fluid to which the low pressure portion 104 of the thrust plate 64 is exposed is relatively low because this portion of the thrust plate is in fluidic communication with the inlet pressure chamber 28. Conversely, the pressure of the fluid to which the high pressure portion 102 of the thrust plate 64 is exposed is relatively high because this portion of the thrust plate is in fluid communication with the outlet pressure chamber 30. Typically, the pressures acting on the thrust plate 64 are balanced causing the thrust plate 64 to form a partial seal against the sides of the gears 14 and 16. The partial seal that is formed permits fluid to pass between the sides of the gears 14 and 16 and the smooth inner face 66 of the thrust plate 64 to provide lubrication therebetween and to permit lubrication of the trunnions and associated bushings.

Referring now to FIGS. 1 and 2, the lubrication of the gear pump 10 will be reviewed. In order to lubricate the trunnions 50 and 54 and their respective associated bushings 38 and 42 in the rear housing portion 20 of the pump, high pressure fluid from the outlet pressure chamber 30 is allowed to pass between the sides of the gears 14 and 16 and the smooth inner face 66 of the thrust plate 64 which is adjacent the rear housing portion 20. The passage of the high pressure fluid causes a pressure gradient to be created between the inner face 66 of the thrust plate 64 and the ends of the trunnions 50 and 54. This pressure gradient is caused by the fluid in the outlet pressure chamber 30 being at the working pressure of the pump which is substantially greater than atmospheric pressure, whereas the fluid which communicates with the ends of the trunnions 50 and 54, via the passageway 56, is at atmospheric pressure. The creation of this pressure gradient causes fluid from the outlet pressure chamber 30 to pass through the apertures 72 and 74 in the thrust plate 64 into the area between the trunnions 50 and 54 and their respective associated bushings 38 and 42. A similar pressure gradient is created on the diametrically opposite side of each trunnion 50 and 54 inasmuch as the fluid in the passageway 56 is at atmospheric pressure whereas the fluid adjacent the bores 82 and 84 in the low pressure portion 104 of the thrust plate 64 is at less than atmospheric pressure. The fluid continues to travel outwardly along the surface of the trunnions 50 and 54 so as to lubricate same and their associated respective bushings 38 and 42 until it approaches the end of the trunnions 50 and 54 at which point the direction of fluid travel gradually changes so as to move inwardly along the trunnions 50 and 54 toward the outer face 68 of the thrust plate 64. The fluid eventually contacts the thrust plate 64 in the low pressure portion 104 thereof and is diverted by slot 92 adjacent bushing 38 and by slot 94 adjacent bushing 42 into bores 82 and 84 which pass through the thrust plate 64. It should be noted that when bore 82 is unobstructed by teeth 44 on gear 14 permitting the flow of fluid therethrough, bore 84 is covered by a tooth 46 on gear 16 preventing fluid from passing therethrough. Conversely, when bore 84 is unobstructed by teeth 46 on gear 16 permitting the flow of fluid therethrough, bore 82 is covered by a tooth 44 on gear 14 preventing fluid from passing therethrough. The unmeshing of the gears 14 and 16 causes a vacuum to be created in the vicinity of the low pressure portion 104 of the thrust plate 64. The placement of elongated slots 86, 88 relative to their associated respective bores 82, 84 maximizes the time period during which each of the bores 82, 84, when unobstructed, is exposed to the vacuum created by the unmeshing of the gears. In this manner, a positive absolute pressure less than atmospheric is created at the unobstructed end of bore 82 and 84 adjacent the inner face 66 of the thrust plate 64. The passage of fluid through the unobstructed bore 82 or 84 creates a pressure drop within the bore which causes the end of unobstructed bore 82 or 84 adjacent the outer face 68 of thrust plate 64 to be at a pressure less than the pressure at the inner face 66 of the plate 64, thus ensuring the establishment of a relatively substantial pressure gradient across the trunnions. It should be noted that because the diameter of each bore 82 and 84 is substantially less than the width of the respective adjacent gear teeth 44, 46 at their point of alignment, any leakage across the inner face 66 of the thrust plate 64 passes to the inlet pressure chamber 28 thus minimizing volumetric losses, and the resulting pressure at the outlet of the bores 82 and 84 is less susceptible to the effects of any pressure gradients across the surface of the thrust plate 64. The fluid which is returned along the trunnions 50 and 54 is allowed to pass through the bores 82 and 84 to the inner face 66 of the thrust plate 64 adjacent the low pressure portion 104 thereof for intermixing with fluid in the inlet pressure chamber 28 and for subsequent transmission to the fluid outlet chamber 30 through the intermeshing of the gears 14 and 16.

Lubrication of the trunnions 48 and 52 and their respective associated bushings 36 and 40 is accomplished in a similar manner. High pressure fluid from outlet pressure chamber 30 is allowed to pass between the sides of the gears 14 and 16 and the smooth inner face 66 of the thrust plate 64 which is adjacent the front housing portion 18. The passage of the high pressure fluid causes a pressure gradient to be created between the inner face 66 of the thrust plate 64 and the ends of trunnions 48 and 52. Here again, this pressure gradient is caused by the fluid in the outlet pressure chamber 30 being at the working pressure of the pump which is substantially greater than atmospheric pressure, whereas the fluid which communicates with the ends of the trunnions 48 and 52, via the passageway 58, is at atmospheric pressure. The creation of this pressure gradient causes fluid from the outlet pressure chamber 30 to pass through the apertures 72 and 74 in the thrust plate 64 into the area between the trunnions 48 and 52 and their respective associated bushings 36 and 40. As in the previous description, a similar pressure gradient is created on the diametrically opposite side of each trunnion 48 and 52 since the the fluid in the passageway 58 is at atmospheric pressure whereas the fluid adjacent the bores 82 and 84 in the low pressure portion 104 of the thrust plate 64 is at less than atmospheric pressure. The fluid continues to travel outwardly along the surface of the trunnions 48 and 52 so as to lubricate same and their associated respective bushings 36 and 40 until it approaches the ends of the trunnions 48 and 52 at which point the direction of fluid travel gradually changes so as to move inwardly along the trunnions 48 and 52 toward the thrust plate 64. When the fluid reaches the thrust plate 64, it is diverted by slot 92 adjacent bushing 36 and by slot 94 adjacent bushing 40 into bores 82 and 84 which pass through the thrust plate 64. As previously described, when bore 82 is unobstructed by teeth 44 on gear 14 permitting the flow of fluid therethrough, bore 84 is covered by a tooth 46 on gear 16 preventing fluid from passing therethrough. Conversely, when bore 84 is unobstructed by teeth 46 on gear 16 permitting the flow of fluid therethrough, bore 82 is covered by a tooth 44 on gear 14 preventing fluid from passing therethrough. Here again, the unmeshing of the gears 14 and 16 causes a vacuum to be created in the vicinity of the low pressure portion 104 of the thrust plate 64. The placement of the elongated slots 86, 88 relative to their associated respective bores 82, 84 maximizes the time period during which each of the bores 82, 84, when unobstructed, is exposed to the vacuum created by the unmeshing of the gears. The foregoing results in a positive absolute pressure less than atmospheric being created at the unobstructed end of bore 82 or 84 adjacent the inner face 66 of the thrust plate 66. The passage of fluid through the unobstructed bore 82 or 84 creates a pressure drop within the bore which causes the opposite end of the unobstructed bore 82 or 84 adjacent the outer face 68 of the thrust plate 64 to be at a pressure less than the pressure at the inner face 66 of the thrust plate 64, thus ensuring the establishment of a relatively substantial pressure gradient across the trunnions. The fluid which is returned along the trunnions 48 and 52 is allowed to pass through the bores 82 and 84 to the inner face 66 of the thrust plate 64 adjacent the low pressure portion 104 thereof for intermixing with fluid in the inlet pressure chamber 28 and for subsequent transmission to the high pressure fluid outlet chamber 30 through the intermeshing of the gears 14 and 16.

Regardless of whether the lubrication of trunnions 50 and 54 or trunnions 48 and 52, and their respective associated bushings, is being considered, the intermeshing of teeth 44 and 46 on gears 14 and 16, respectively, prevents the high pressure fluid from being communicated directly from the outlet pressure chamber 30 across the inner face 66 of the thrust plate 64 to bores 82 and 84. The high pressure fluid from the outlet pressure chamber 30 must transverse outwardly along the surface of the trunnions to their approximate end and then inwardly along the trunnions to the bores 82 and 84 within the low pressure portion 104 of the thrust plate 64. Any leakage of fluid that might occur across the inner face 66 of the thrust plate 64 is minimal and passes to the inlet pressure chamber 28.

Certain modifications and improvements will occur to those skilled in the art upon reading the foregoing. It should be understood that all such modifications and improvements have been deleted herein for the sake of conciseness and readability, but are properly within the scope of the following claims.

I claim:

1. A thrust plate for a gear pump or the like comprising a plate member having two circular portions each with an aperture therethrough defining a figure-eight configuration, said plate member having a gear tooth confronting surface and a housing sealing surface each including a first pressure region and a second pressure region, said first pressure region being at a pressure different than the pressure at said second pressure region, said plate member also including a fluid transmitting path in each of said circular portions between said first pressure region on said gear tooth confronting surface and said second pressure region on said housing sealing surface, said fluid transmitting path comprising a slot from each of said apertures in said circular portions of said plate member and a bore which passes through said slot and interconnects said housing sealing surface and said gear tooth confronting surface.

2. The thrust plate as defined in claim 1 wherein said slots and said bores are positioned in one of said first and second pressure regions on said plate member.

3. The thrust plate as defined in claim 1 wherein said slots are positioned in said housing sealing surface of said plate member.

4. The thrust plate as defined in claim 1 further including a slot which interconnects said slots from each of said apertures in said circular portions of said plate member.

5. The thrust plate as defined in claim 1 further including a slot positioned in said gear tooth confronting surface of said plate member and in fluidic communication with said bore.

6. The thrust plate as defined in claim 1 wherein said first pressure region is at a pressure greater than the pressure at said second pressure region.

7. A fluid pump or motor comprising a housing having first and second ports, intermeshed gears in said housing cooperable to move fluid from one port to the other port, and a plate member received in said housing adjacent to the ends of said gears and having two circular portions each with an aperture therethrough defining a figure-eight configuration, said plate member having a gear tooth confronting surface and a housing sealing surface each including a first pressure region and second pressure region, said first pressure region being at a pressure different than the pressure at said second pressure region, said plate member also including a fluid transmitting path in each of said circular portions between said first pressure region on said gear tooth confronting surface and said second pressure region on said housing sealing surface, said fluid transmitting path comprising a slot from each of said apertures in said circular portions of said plate member and a bore which passes through said slot and interconnects said housing sealing surface and said gear tooth confronting surface.

8. The gear pump or motor as defined in claim 7 wherein said slots and said bores are positioned in one of said first and second pressure regions on said plate member.

9. The gear pump or motor as defined in claim 7 wherein said slots are positioned in said housing sealing surface of said plate member.

10. The gear pump or motor as defined in claim 7 further including a slot which interconnects said slots from each of said apertures in said circular portions of said plate member.

11. The gear pump or motor as defined in claim 7 further including a slot positioned in said gear tooth confronting surface of said plate member and in fluidic communication with said bore.

12. The gear pump or motor as defined in claim 7 wherein said first pressure region is at a pressure greater than the pressure at said second pressure regions.

* * * * *